US005850748A

United States Patent [19]

Kim et al.

[11] Patent Number: 5,850,748

[45] Date of Patent: Dec. 22, 1998

[54] FRONT LOADING CLOTHES WASHING MACHINE WITH DYNAMIC BALANCING MECHANISM

[75] Inventors: Cin Yong Kim, Suwon; Do Weon Kim, Seoul; Jin Soo Kim; Sam Yong Jang, both of Suwon; Geum Chan Lee, Seoul, all of Rep. of Korea

[73] Assignee: Samsung Electronics Co., Ltd., Suwon, Rep. of Korea

[21] Appl. No.: 774,876

[22] Filed: Dec. 27, 1996

[30] Foreign Application Priority Data

| | | | |
|---|---|---|---|
| Dec. 28, 1995 | [KR] | Rep. of Korea | 1995 50073 U |
| Feb. 15, 1996 | [KR] | Rep. of Korea | 1996 3764 |
| May 30, 1996 | [KR] | Rep. of Korea | 1996 13846 U |
| May 11, 1996 | [KR] | Rep. of Korea | 1996 11524 U |

[51] Int. Cl.[6] ..... D08F 37/22

[52] U.S. Cl. ..... 68/23.2; 68/23.3; 74/573 F; 74/573 R

[58] Field of Search ..... 134/23.2, 23.3; 210/144; 74/573 F, 573 R

[56] References Cited

U.S. PATENT DOCUMENTS

| | | | |
|---|---|---|---|
| 2,984,094 | 5/1961 | Belaieff | 68/23.2 |
| 4,423,607 | 1/1984 | Munini | 68/23.2 |
| 5,460,017 | 10/1995 | Taylor | 68/23.2 |

FOREIGN PATENT DOCUMENTS

| | | | |
|---|---|---|---|
| 390343 | 10/1990 | European Pat. Off. . | |
| 2746989 | 4/1978 | Germany | 68/23.2 |
| 2284079 | 4/1979 | Germany | 68/23.2 |
| 54-26071 | 2/1979 | Japan | 68/23.2 |
| 1461796 | 2/1989 | U.S.S.R. | 68/23.2 |

*Primary Examiner*—Frankie L. Stinson
*Attorney, Agent, or Firm*—Burns, Doane, Swecker & Mathis, L.L.P.

[57] ABSTRACT

A front loading clothes washing machine includes a spin basket rotatably driven about a horizontal axis. Axially spaced front and rear sides of the spin basket are formed by panels. Disposed on each of the front and rear panels is a dynamic balancing mechanism comprised of an annular chamber arranged coaxially with the axis of rotation. The chamber contains a liquid and a plurality of balls freely movable within the liquid.

14 Claims, 9 Drawing Sheets

FRONT LOADING CLOTHES WASHING MACHINE WITH DYNAMIC BALANCING MECHANISM

FIELD OF THE INVENTION

The present invention relates generally to a drum type washing machine with balancing devices provided to a spin basket which rotates about a horizontal axis.

BACKGROUND OF THE INVENTION

A conventional drum type washing machine, which performs a washing/hydro-extracting (spin-drying) task with the rotation of its spin basket, has balancers that prevent the spin basket from producing abnormal vibrations due to laundry not being evenly arranged therein. There are two types of balancing devices: a counterweight balancer that reduces the vibration by means of a counterweight having a predetermined weight, and a liquid balancer which is provided on a washing machine's spin basket in order to oppose an imbalance of laundry and restrain the generation of vibration.

FIG. 7 schematically illustrates a conventional drum type washing machine with counterweights.

The drum washing machine includes a housing 1, a tub 2 held by suspension arms in the housing 1, and a spin basket 3 rotatably provided in the tub 2. An electric motor 8, installed below the tub 3, rotates the tub 3 about a shaft (not illustrated) horizontally installed, thereby performing a washing/hydro-extracting task. Counterweights 4*a* and 4*b*, each of predetermined weight, are attached to the tub 2 to prevent the production of vibration during the washing/hydro-extracting operation. The counterweight 4*a* attached to the front of the tub 2 is 11.4 kg, and the counterweight 4*b* provided to the top of the tub 2 is 12.2 kg. These counterweights 4*a* and 4*b* are made from cast iron and are joined to the tub 2 by bolts 4*c*.

The above-described conventional drum type washing machine has the following disadvantages:

First, the conventional balancer using the counterweights only lowers the amplitude of vibrations generated during operation rather than eliminating them entirely. Second, since these counterweights are quiet heavy, it is difficult to install them on the tub and the overall weight of the washing machine is increased, resulting in difficult construction and transport. Third, the bolts which fasten the counterweights to the tub, over long periods of use, loosen due to corrosion or fatigue, resulting in noise, and, in the worst case, the possibility of damage to the balancer and the washing machine as well.

To solve the aforementioned problems, a liquid balancer directly installed in a washing machine's spin basket was proposed in EP Publication No. EP 0 390 343 A2.

FIG. 8 depicts a conventional drum washing machine employing such a liquid balancer.

The drum washing machine of FIG. 8 includes a housing 1, a tub 2 held by suspension arms in the housing 1, an spin basket 3 rotatably installed within the tub 2, and an electric motor 8 installed below the tub 2 to rotate the spin basket 3. The tub 2 serves as a water tub, and the spin basket 3 is disposed within the tub 2 parallel to the ground rather than upright. One end 5*a* of a horizontally-supported shaft 5 is joined to the back of the spin basket 3. The other end 5*b* of the shaft 5 extends to the outside of the tub 2, and is connected to the motor 8 through a drive belt 6 so that the motor 8 can rotate the spin basket 3.

The washing operation of such a drum washing machine is carried out by suds created by the rotation of the spin basket 3. After the washing and rinsing of the clothes, excess water is removed from the clothes by centrifugal force created by the spin basket 3 turning at high speeds during the hydro-extracting process so that they contain only enough moisture for ironing.

A balancer is provided to the front of the spin basket 3 so as to prevent vibration from being produced during the high-speed rotation. The balancer is realized as an annular passageway 7 and a liquid, commonly a saline solution, of given quantity contained therein.

The center of gravity S–S' of the basket 3 is offset from the geometric center O–O' of the spin basket 3 due to the laundry being gathered on one spot in the spin basket 3. The liquid housed in the passageway 7 is moved to oppose an imbalance resulting from of the centrifugal force caused by that offset relationship.

In such a conventional drum washing machine, however, the liquid used to counteract the imbalance and decrease the vibration amplitude of the spin basket cannot eliminate the vibration completely. Consequently, the spin basket rotates eccentric relative to the center of gravity thereby creating abnormal vibrations, causing the washing machine's components such as bearings to wear out prematurely and the deterioration of the durability of the washing machine.

Additionally, when the magnitude of the spin basket's unbalance exceeds the critical point of counterbalance, the liquid balancer is incapable of dynamically balancing the spin basket. In order to compensate for such an imbalance sufficiently, the liquid balancer must be of great bulk. However, it is not easy to install such a heavy liquid balancer on the washing machine.

SUMMARY OF THE INVENTION

The present invention is a drum washing machine with improved balancing devices that can satisfy the aforementioned need.

It is an objective of the present invention to provide a drum type washing machine that can eliminate the vibration of its spin basket and prevent the spin basket's axis of rotation from deviating from its center of gravity.

It is another objective of the present invention to provide a drum type washing machine with balancing devices which can more effectively counteract an imbalance in its spin basket.

In order to obtain the aforementioned objectives of the present invention, the inventive drum type washing machine includes: a housing, a tub suspended horizontally within the housing, a spin basket rotatably mounted horizontally inside the tub, a motor rotating the spin basket, and balancing devices having radially spaced annular chambers provided to at least one of the two sides of the spin basket and a plurality of balls freely movable within the respective chambers which dynamically counterbalance imbalances produced during the rotation of the spin basket.

The chambers are concentrically formed and contain a given amount of liquid with a prescribed viscosity. The diameter of the balls in the inner chamber is smaller than that of the balls in the outer chamber, and the outer chamber's corners are less tightly curved than the inner chamber's corners. The chambers are formed by connecting the spin basket's side panel, which has a first annular groove formed therein, with a plate member, which has a second groove corresponding to the first groove. The plate member is joined to the side panel by the use of either bolts or rivets. The first and second grooves are designed to be substantially different from each other in axial depth, and the depth of one of the grooves is larger than the radius of the respective balls.

The chambers are respectively provided to both sides of the spin basket, and each chamber is connected to the outer circumference of the spin basket by bolts attached to the spin basket's outer surface. A third groove may be formed on a portion of the side panel of the spin basket corresponding to the first groove so as to accommodate the first groove of the first plate member.

BRIEF DESCRIPTION OF THE ATTACHED DRAWINGS

Figure 7:
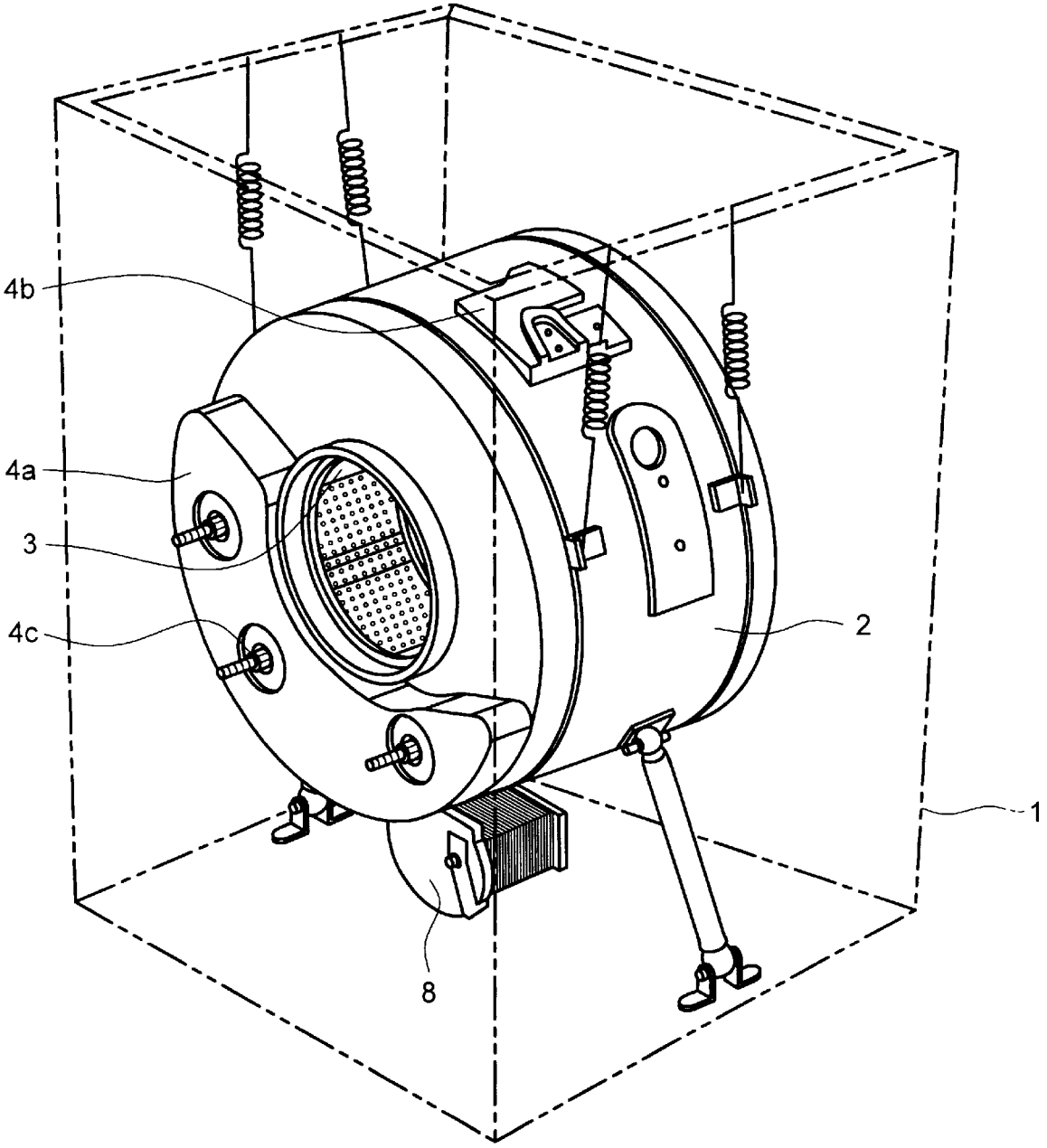
FIG. 7 (PRIOR ART)
Figure 8:
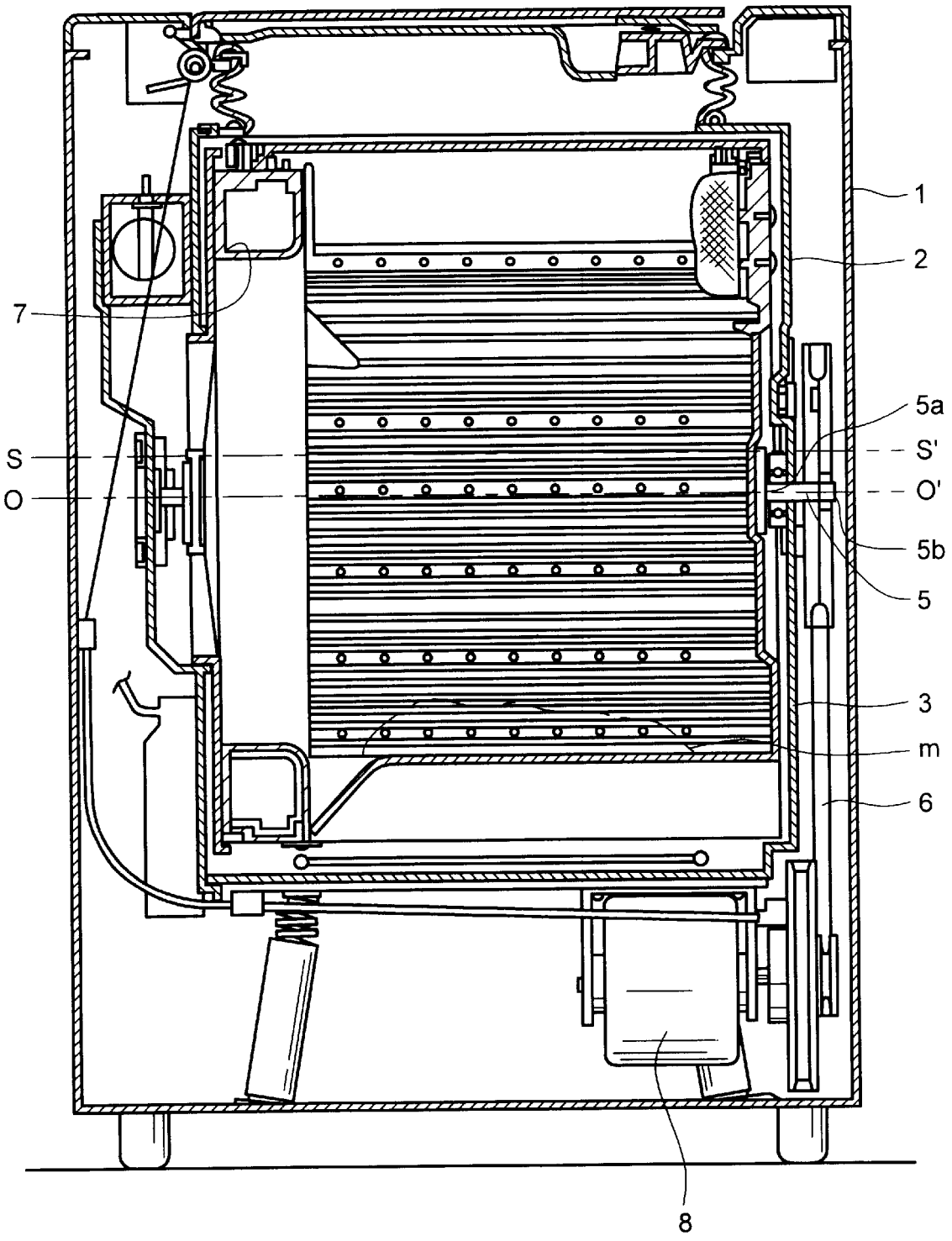
FIG. 8 (PRIOR ART)

FIG. 7 schematically illustrates a front perspective view of a convention drum type washing machine with counterweights for counteracting an imbalance in a spin basket; and FIG. 8 depicts a vertical sectional view of a conventional drum type washing machine employing a liquid balancer.

DETAILED DESCRIPTION OF PREFERRED EMBODIMENTS

Reference will now be made in detail to the preferred embodiments of the present invention, examples of which are illustrated in the accompanying drawings.

Figure 1:
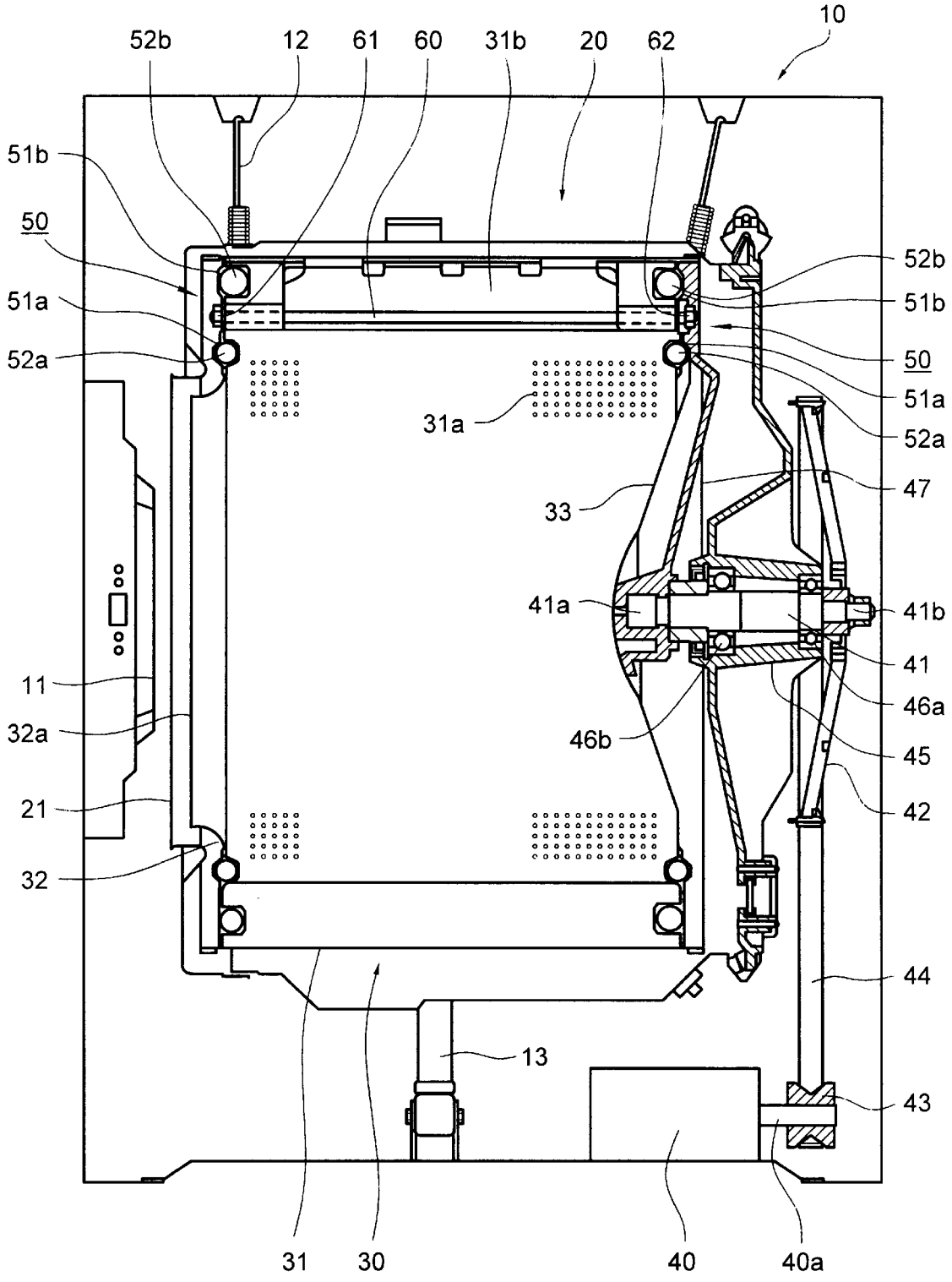
FIG. 1 is a side-sectional view of a drum type washing machine with balancing devices using balls in accordance with the present invention.

FIG. 1 is a side-sectional view of a drum washing machine with a balancing device using balls in accordance with the present invention.

The drum washing machine of FIG. 1 includes a housing 10, a tub 20 held in the housing 10, a spin basket 30 rotatably installed within the tub 20, and an electric motor 40, which rotates the spin basket 30, installed below the tub 20. The housing 10 is a quadrangular case, and the spin basket 20 is cylindrical in shape and horizontally held by four buffer springs 12 arranged at four locations in the housing 10. The spin basket 30, also of cylindrical shape, is horizontally disposed within the tub 20. Each of the buffer springs 12 has an upper end connected to the housing 10 and a lower end connected to the top of the tub 20. A pair of shock absorbers 13 are installed between the lower part of the tub 20 and the housing 10.

Openings 11, 21 and 32*a* are formed respectively on: the front of the housing 10, a predetermined spot of the tub 20 corresponding to that of the housing 10, and a corresponding spot of the spin basket 30. A door (not illustrated) is disposed on the front of the housing 10 that opens and closes the entrance to the tub 20 and the spin basket 30. The spin basket 30 consists of a cylindrically-shaped body 31, and side panels 32 and 33 each constituting the front and back of the body 31. A plurality of holes 31*a* are uniformly distributed in the body 31 so that water can flow freely between the spin basket 30 and the tub 20. A plurality of lifters 31*b* are provided to the body 31 and designed to protrude inward in the form of a "V", spaced 60° from each other. These lifters 31*b* raise and drop laundry during washing. A horizontally-supported shaft 41 has one end 41*a* connected to the side panel 33 that forms the back of the spin basket 30, and the other end 41*b* extending to the rear of the tub 20 and connected to a first pulley 42. A belt 44 is provided between the first pulley 42 and a second pulley 43 that is connected to the motor shaft 40*a* so that the rotating force of the motor 40 is transmitted to the spin basket 30.

As described above, the shaft 41 is horizontally supported by a pair of bearings 46*a* and 46*b* placed in a bearing housing 45. A supporting member 47 has an outer end diverged in three directions and extends to the side panel 33's edge to be joined to the side panel 33 of the spin basket 30 so that the one end 41*a* of the shaft 41 is connected to the center of the supporting member 47.

The spin basket 30 includes a pair of balancing devices 50 provided to respective side panels 32 and 33 so as to remove the vibration and imbalance created during rotation. The balancing devices 50 are oppositely disposed respectively to each other thereby offsetting movement created during rotation and enhancing the balancing characteristics. Each of balancing devices 50 comprises annular chambers 51*a* and 51*b* that are formed on radially inner and outer parts of each of the side panels 32 and 33, and spherically balls 52*a* and 52*b* that are seated in the chambers 51*a* and 51*b*, respectively. The balls move along the corresponding chambers to oppose an imbalance in the spin basket 30. A secondary plate member 53 closes the chambers 51*a*, 51*b* (as will be described in more detail subsequently). The plate members in FIG. 1 are secured to respective side panels 32, 33 by means of bolts 60 which extend completely through the spin basket. Each bolt includes a head 62 at one end, and a coupling nut 61 is threaded to the other end of each bolt 60.

The chambers 51*a* and 51*b* contain a liquid of a predetermined viscosity, such as an oil, in order to facilitate the movement of the balls 52*a* and 52*b* and to enhance the balancing characteristics. In other words, when there is an imbalance in the spin basket 30, the balls 52*a* and 52*b* and the liquid relocate to a predetermined position to oppose the imbalance. If the magnitude of the imbalance does not exceed a predetermined critical point of counterbalance of the balancing devices, the balls 52*a* and 52*b* move close to each other to make the vibration amplitude zero so the liquid does not flow.

If the magnitude of the imbalance still exceeds the critical point of counterbalance, after the balls have moved into their counterbalancing position, the liquid is then also moved to oppose the imbalance, thereby countering the unbalanced state of the basket 30.

Each of the balancing devices 50 includes at least one chamber and a plurality of the balls seated therein. The inner and outer chambers 51*a* and 51*b* are concentric to the axis of rotation and radially spaced from each other by a predetermined distance. They are sealed by means to be subsequently described. The balls 52*a* in the inner chambers 51*a* are designed to be smaller than the balls 52*b* in the outer chambers 51*b* so that there is a difference between the balancing effects of the inner and outer chambers 51*a* and 51*b* to thereby ensuring a more delicate counterbalancing action.

The balancing effect is in proportion to the centrifugal force ($F=MRW^2$), and the control effect of the radially inner balancing device is designed to be smaller than that of the outer one by reducing the mass of the balls 52*a* seated in the inner chambers 51*a* so that the overall control technique is more sophisticated.

The coupling structure of the chambers 51*a* and 51*b* will be more fully described as follows.

As described above, the balancing devices 50 provided to the both side panels 32 and 33 are formed symmetrically, and the structure of the chambers 51*a* and 51*b* on the side panel 32 will be described by way of example. The inner chambers 51*a* and the outer chambers 51*b* of different size have essentially the same construction, and the inner chambers 51*a* are now described as an example.

Figure 2A:
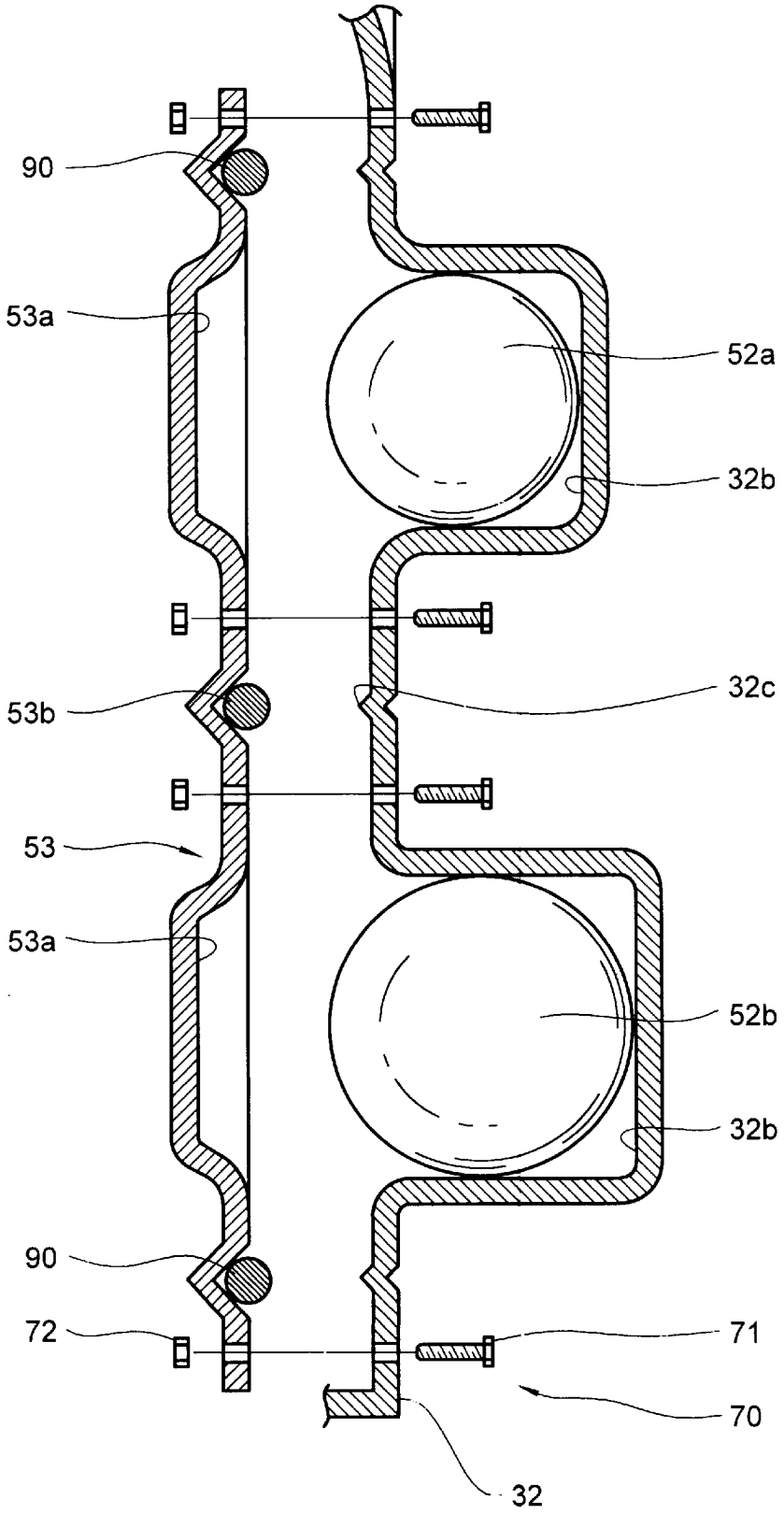
FIGS. 2A and 2B are exploded and assembled views, respectively, depicting a chamber coupling structure in accordance with the first preferred embodiment of the present invention.
Figure 2B:
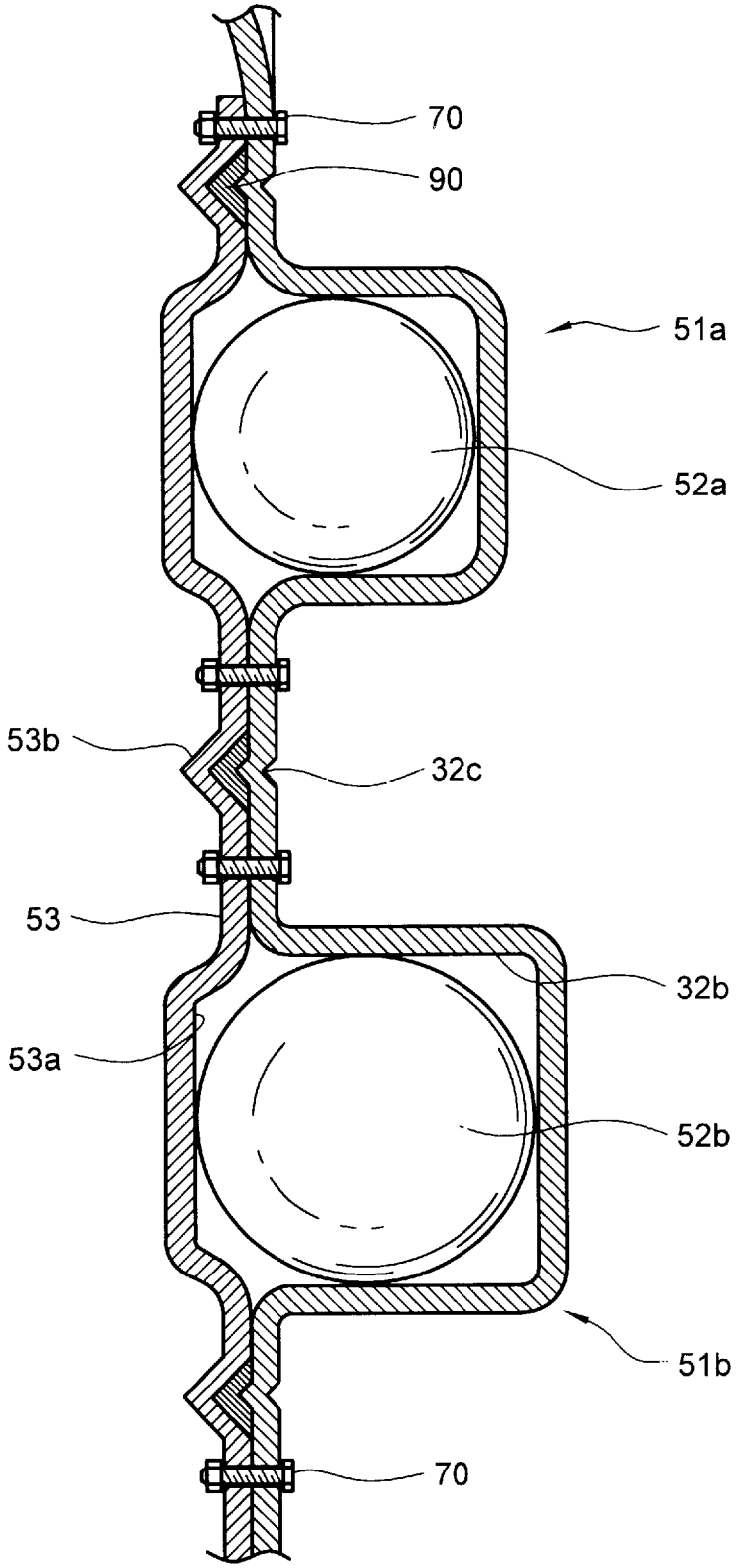

FIGS. 2A and 2B are enlarged views of an alternative coupling structure of the chambers 51*a* and 51*b*.

Each of the chambers 51*a*, 51*b* is formed by the combination of a first groove 32*b* formed axially inward on the side panel 32 of the spin basket 30 and a second groove 53*a* formed in axial alignment with to the first groove 32*b*. More specifically, the second groove 53*a* is formed on a secondary plate member 53, and the plate member 53 is joined to the side panel 32 of the spin basket 30 by the use of small bolts 70. Nuts 72 are then screw onto the bolts whose bolt heads 71 are axially facing the inside of the spin basket 30. The panel 32 (and also 33) includes three bent portions 32*c* arranged to straddle both of the chambers 51*a*, 51*b*. Those bent portions form projections which oppose respective recesses formed by bent portions 53*b* of the plate member 53. Packing material 90 is inserted between the bent portions 32*c* and 53*b* and compressed to form a seal so as to eliminate leakage of the oil from the chambers 51*a*, 51*b*.

Figure 3:
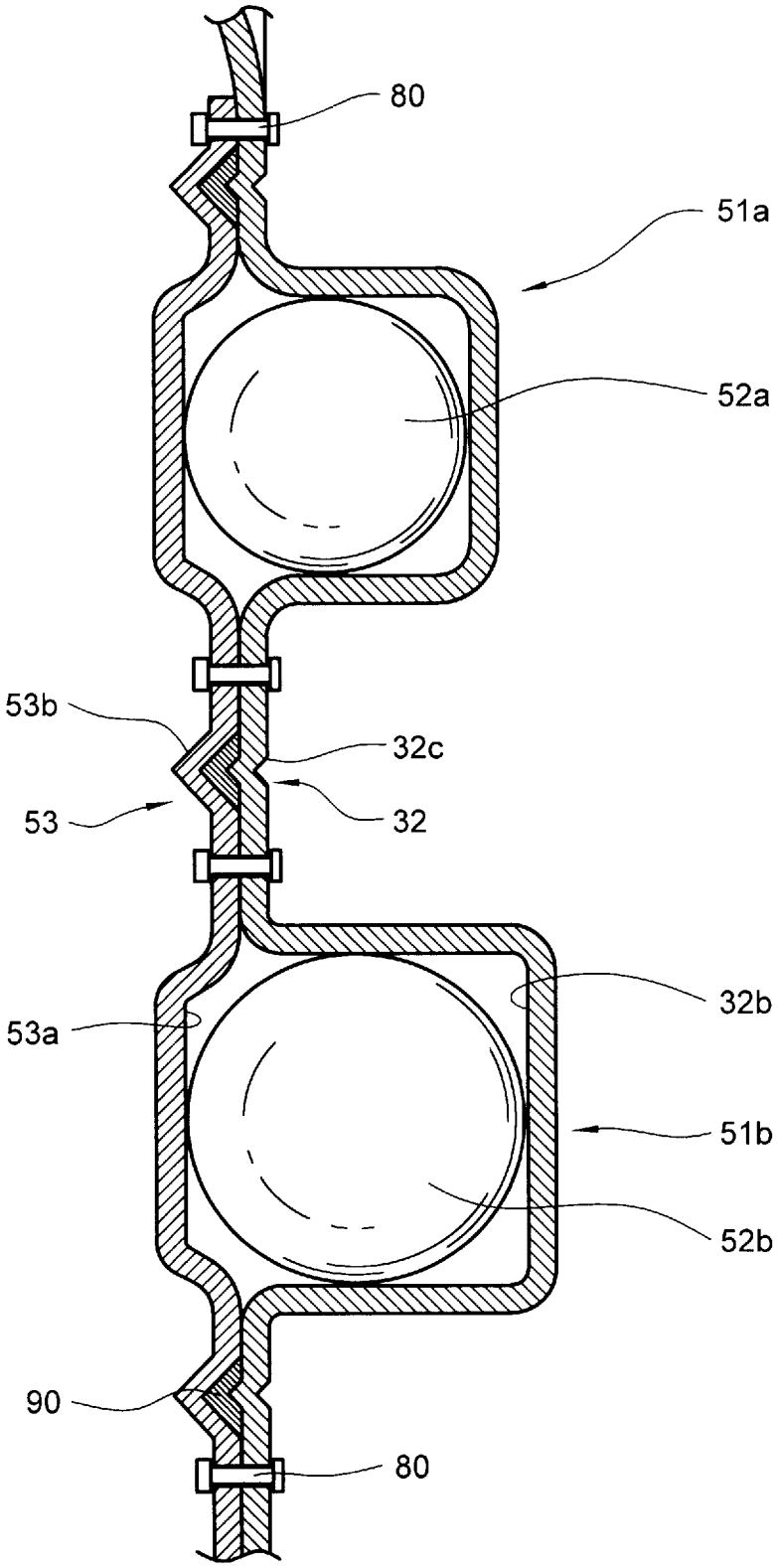
FIG. 3 depicts a chamber coupling structure in accordance with the second preferred embodiment of the present invention.

FIG. 3 depicts a chamber coupling structure in accordance with a second preferred embodiment of the present invention.

In this embodiment, the plate member 53 is joined to the side panel 32 of the spin basket 30 by the use of rivets 80. The rivets 80 are pressed from the outside of the spin basket 30 to fasten the panel 32 and side panel 32 together.

Figure 4:
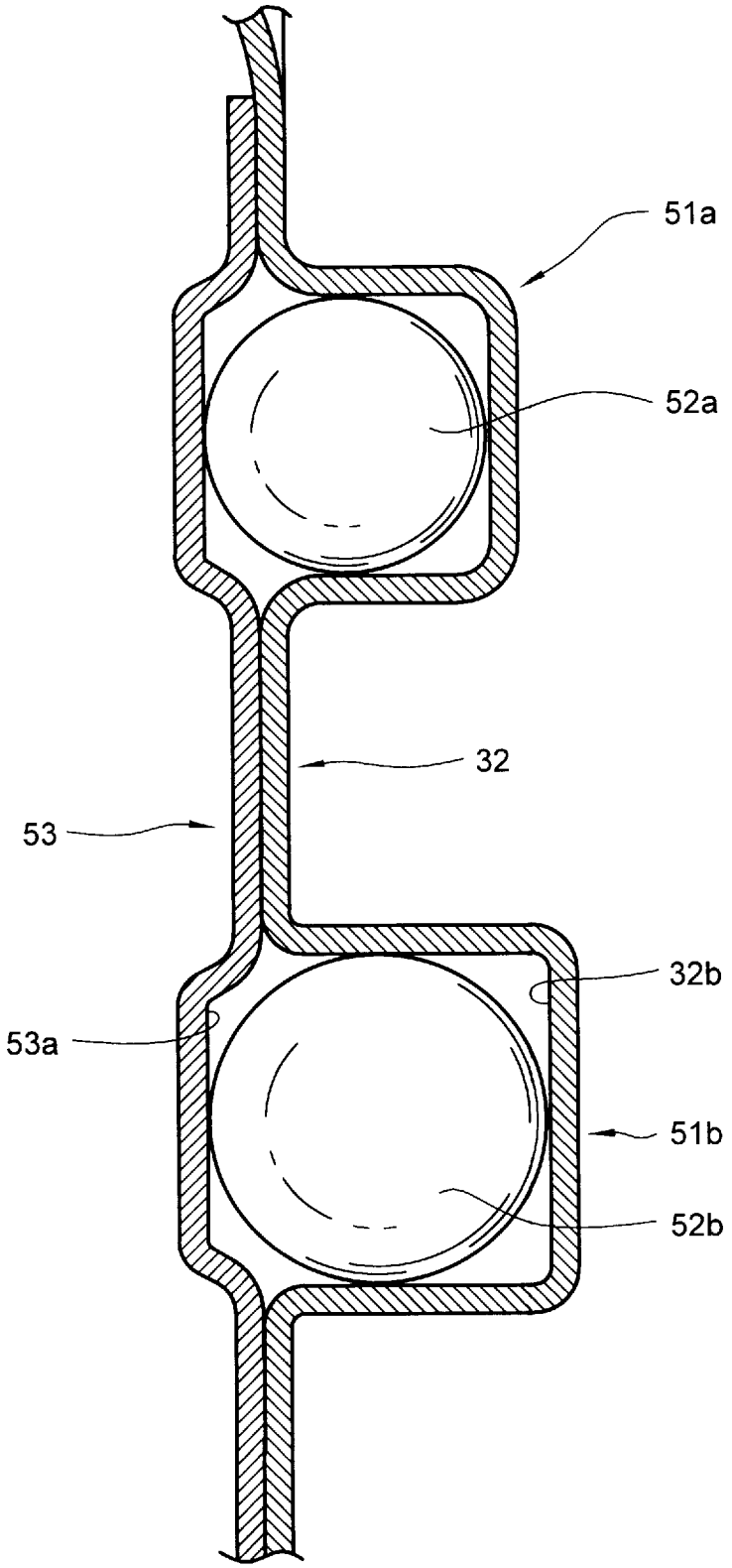
FIG. 4 depicts a chamber coupling structure in accordance with the third preferred embodiment of the present invention.

FIG. 4 depicts a chamber coupling structure in accordance with a third preferred embodiment of the present invention.

In this embodiment, the plate member 53 is joined to the side panel 32 of the spin basket 30 by welding.

Figure 5:
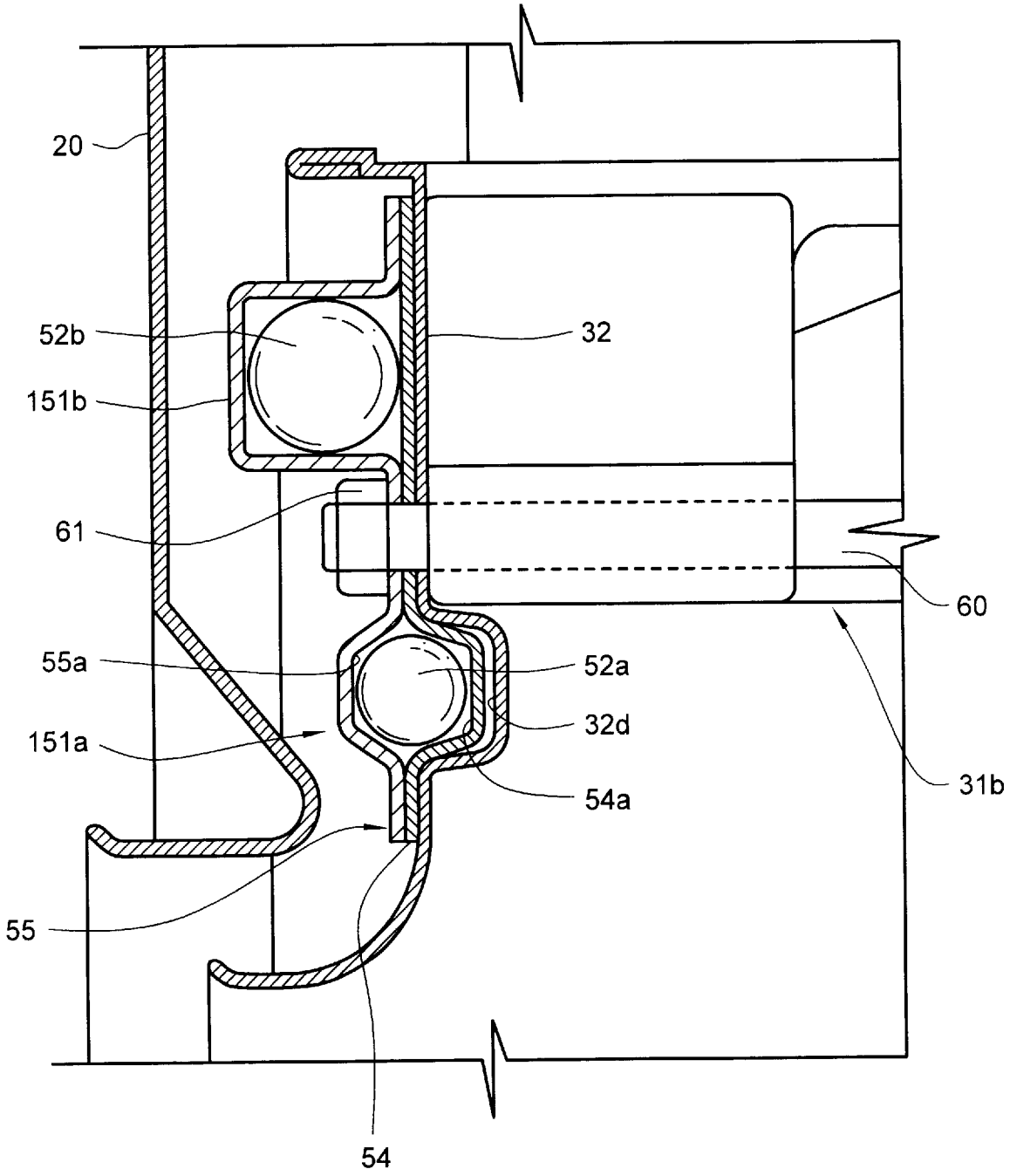
FIG. 5 depicts a chamber coupling structure in accordance with the fourth preferred embodiment of the present invention.

FIG. 5 depicts a chamber coupling structure in accordance with a fourth preferred embodiment of the present invention.

A radially inner 151*a* is formed by the combination of a first plate member 54 with a first annular groove 54*a* formed inward thereon and a second plate member 55 with a second annular groove 55*a* formed outward thereon corresponding in location to the first groove 54*a*. A radially outer chamber 151*b* is also formed by the plate members 54, 55. The first plate member 54 is connected to the second plate member 55 by welding, and a bolt 60 disposed closely to the outer surface of a lifter 31*b* is used to fasten the members 54 and 55 to the side panel 32. The bolt 60 is similar to that disclosed earlier in connection with FIG. 1.

Accordingly, the parts where the members 54 and 55 are joined together by welding are not exposed to the inside of the spin basket 30, thereby eliminating corrosion and oxidization on those joints, and making the inside of the spin basket 30 smooth. The bolt 60 extends along the outer surface of the lifter 31*b*, and its bolt head 62 (see FIG. 1) abuts against the outside of the balancing device 50 located at the axial rear. A nut 61 screws onto the bolt 60 in front of the axial other balancing device 50 placed on the front so that the front and rear balancing devices 50 are joined together, with the spin basket 30 disposed therebetween. The bolt 60 is situated radially between the radially inner chamber 151*a* and the radially outer chamber 151*b*.

To create the inner chamber 115*a*, a third groove 32*d* is formed on a portion of the side panel 32 corresponding in location to the first groove 54*a* of the first plate member 54 in order to accommodate the first groove 54*a*, and the combination of the first and second plate members 54 and 55 is designed to lie flush with the side panel 32.

Figure 6:
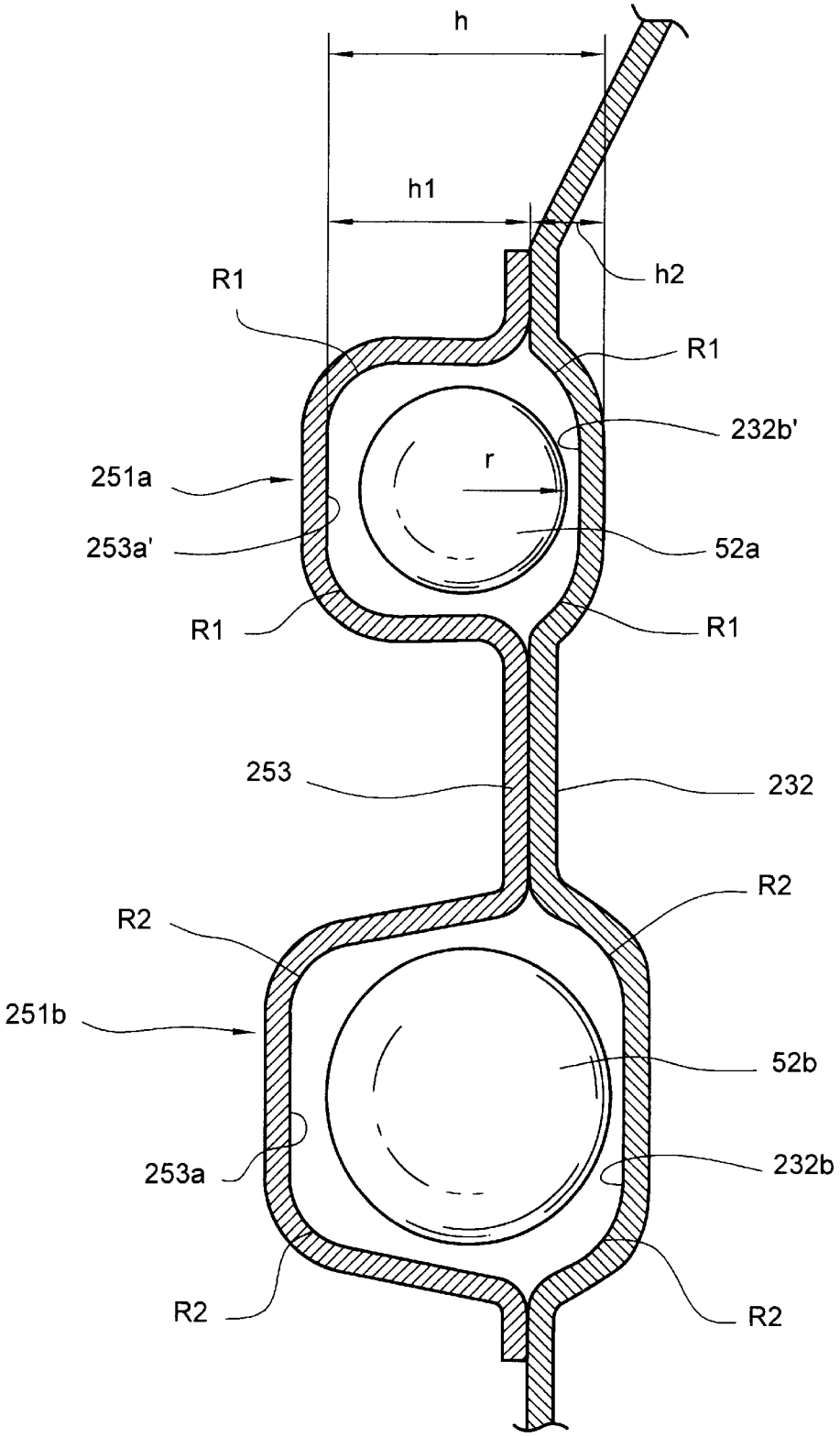
FIG. 6 depicts chambers each formed with a predetermined depth and having curved corners in accordance with the present invention.

Referring now to FIG. 6, another chamber structure is fully described as follows.

The contact points (i.e., the interface) between the plate member 253 and the side panel 232, which form the chambers 251*a* and 251*b*, do not lie in the plane created by the centers of the balls 52*a* and 52*b*. This is so because the depth $h_2$ of the axial inner groove 232*b'* is different from the depth $h_1$ of the axial outer groove 253*a'*, allowing the balls 52*a* and 52*b* to freely move along the chambers. In other words, the first groove 232*b'* and the second groove 253*a'* are designed to respectively have different depths $h_2$ and $h_1$, and the depth $h_1$ of the second groove 253*a'* is larger than each radius "r" of the balls 52*a*. Also, the depth $h_1$ of the second groove 253*a* is larger than ½ of the overall depth "h" of the chamber 251*a*. The above-described relationship between the groove depths and ball radii pertaining to the chamber 251*a* is also true of the corresponding relationships pertaining to the other chamber 251*b*.

Each corner of the radially inner chamber 251*a* and radially outer chamber 251*b* is designed to be rounded to form curved portions $R_1$ and $R_2$. The curvature of the curved portion $R_1$ is different from that of the curved portion $R_2$ so that the balls 52*a* and 52*b* move along the respective inner and outer chambers 251*a* and 251*b* at the same speed. In other words, should the difference in curvature not exist, the relatively small and light ball 52*a* would move through the inner chamber 251*a* faster than the ball 52*b* in the outer chamber 251*b*. The curved portions $R_1$ of the inner chamber 251*a* being more tightly curved than those of the outer chamber 251*b* ensures that the balls 52*a* and 52*b* move along the corresponding inner and outer chambers 251*a* and 251*b* at the same speed.

The following description relates to the operation of the drum washing machine with the inventive balancing devices.

The washing machine removes soil from the garments by agitation accomplished by the spin basket 30 during washing. During the hydro-extracting (spin-drying) action of the washing process, the garments are located on the lower part of the spin basket 30. If the spin basket 30 becomes unbalanced as it rotates at high speeds, the centrifugal force of the spin basket 30 moves the balls 52*a* and 52*b* along the chambers 51*a* and 51*b* (or 151*a* and 151*b*, or 251*a* and 251*b*) to a position which will rebalance the basket 30, thereby eliminating vibrations and eccentric rotation of the spin basket 30.

More specifically, once there is an imbalance in the spin basket 30, movable bodies consisting of the balls 51*a* and 51*b* and liquid become situated on the opposite side of the imbalance. When the magnitude of the imbalance remains below a critical point of counterbalance of the balls, the balls 51*a* and 51*b* move close to each other to eliminate the vibration (i.e. to make the center of gravity and center of rotation of the spin basket 30 the same). As the vibration amplitude becomes zero, the flow of the liquid within the chambers is minimal. If the magnitude of the imbalance still exceeds the critical point of counterbalance, after the balls have moved into their counterbalancing position, the liquid is then also moved to oppose the imbalance, thereby countering the unbalanced state of the basket 30.

As described above, the balls of the present invention make the vibration amplitude zero and counteract an imbalance in the spin basket to thereby eliminate resultant deformation of the spin basket. The inventive balancing devices may prevent unnecessary wear of the components used to support the rotation of the spin basket and noise created by friction. The balancing devices employ the balls and liquid at the same time, and have superior balancing characteristics with reduced bulk. The chambers of the balancing devices are easily formed by bolts and nuts or by welding, and the parts where the plate member and the side panel join together by welding are not exposed to the inside of the spin basket thereby preventing corrosion and oxidization of those joints. Additionally, the interface formed by chamber-forming plates is not aligned with the center of each ball so that the balls are freely movable in the chambers.

What is claimed is:

1. A front-loading washing machine, comprising:

a housing;

a front-loading tub suspended within the housing;

a spin basket mounted within the tub for rotation about a horizontal axis, the spin basket including axially spaced front and rear sides;

a drive mechanism for rotating the spin basket; and a dynamic balancing mechanism mounted on the spin basket at least at one of the front and rear sides thereof for balancing the spin basket during rotation thereof, the balancing mechanism comprising:

an annular chamber mounted on the at least one side in coaxial relationship with the horizontal axis, and a plurality of balls freely movable within the chamber;

wherein the at least one side of the spin basket comprises a panel, a first annular groove formed in the panel, and a plate member mounted in opposing relationship to the panel such that a second annular groove formed in the plate member is axially aligned with the first groove to form therewith the annular chamber.

2. The washing machine according to claim 1 wherein the chamber contains a liquid in which the balls move.

3. The washing machine according to claim 1 wherein the chamber comprises a first chamber, the dynamic balancing mechanism further comprising a second annular chamber arranged concentrically with the first chamber and spaced radially therefrom, another plurality of balls being freely movable within the second chamber.

4. The washing machine according to claim 3 wherein each of the first and second chambers includes an inner surface forming four corners when viewed in cross section; each corner being curved, with the corners of a radially inner one of the chambers being more tightly curved than the corners of a radially outer one of the chambers; the balls of the inner chamber being of smaller diameter than the balls of the outer chamber.

5. The washing machine according to claim 1 wherein the spin basket includes first and second panels forming the first and second sides, respectively, of the spin basket; the panels being interconnected by a generally cylindrical outer wall of the spin basket; the annular chamber disposed on one of the first and second panels so as to be spaced radially inwardly from the outer wall.

6. The washing machine according to claim 5 wherein another of the balancing mechanisms is mounted at the other side of the spin basket.

7. The washing machine according to claim 1 wherein the plate member is joined to the panel by bolts.

8. The washing machine according to claim 1 wherein the plate member is joined to the panel by rivets.

9. The washing machine according to claim 1 wherein an axial depth of one of the first and second grooves is greater than that of the other of the grooves and is larger than a radius of the balls.

10. The washing machine according to claim 1 wherein another of the balancing mechanisms is mounted at the other of the front and rear sides of the spin basket.

11. The washing machine according to claim 10 wherein the first and second plate members of the balancing mechanisms are attached to the spin basket by means of axial bolts which extend completely through the spin basket.

12. The washing machine according to claim 11 wherein the panel includes a third groove receiving one of the first and second grooves.

13. The washing machine according to claim 1 wherein another of the balancing mechanisms is mounted at the other of the front and rear sides of the spin basket.

14. A front-loading washing machine, comprising:

a housing;

a front-loading tub suspended within the housing;

a spin basket mounted within the tub for rotation about a horizontal axis, the spin basket including axially spaced front and rear sides;

a drive mechanism for rotating the spin basket; and a dynamic balancing mechanism mounted on the spin basket at least at one of the front and rear sides thereof for balancing the spin basket during rotation thereof, the balancing mechanism comprising:

an annular chamber mounted on the at least one side in coaxial relationship with the horizontal axis, and a plurality of balls freely movable within the chamber;

wherein the at least one side of the spin basket comprises a panel, a first and second plate members connected to the spin basket, the first and second plate members having first and second grooves formed therein, the first and second grooves being axially aligned with one another to form the annular channel.

* * * * *